US009551362B2

(12) United States Patent
Veit et al.

(10) Patent No.: US 9,551,362 B2
(45) Date of Patent: Jan. 24, 2017

(54) HYDRAULIC SYSTEM WITH SUCTION/RETURN FILTER

(75) Inventors: Jan-Martin Veit, Reutlingen (DE); Markus Stass, Moeglingen (DE); Werner Muenzenmaier, Nuertingen (DE); Hans-Peter Renz, Filderstadt (DE)

(73) Assignee: Putzmeister Engineering GmbH, Aichtal (DE)

( * ) Notice: Subject to any disclaimer, the term of this patent is extended or adjusted under 35 U.S.C. 154(b) by 390 days.

(21) Appl. No.: 14/346,024

(22) PCT Filed: Aug. 15, 2012

(86) PCT No.: PCT/EP2012/065931

§ 371 (c)(1),
(2), (4) Date: Mar. 20, 2014

(87) PCT Pub. No.: WO2013/045167

PCT Pub. Date: Apr. 4, 2013

(65) Prior Publication Data

US 2014/0230424 A1 Aug. 21, 2014

(30) Foreign Application Priority Data

Sep. 30, 2011 (DE) ..... 10 2011 083 874

(51) Int. Cl.
*E01C 19/47* (2006.01)
*F15B 13/07* (2006.01)
(Continued)

(52) U.S. Cl.
CPC ..... *F15B 13/07* (2013.01); *E01C 19/475* (2013.01); *F15B 1/027* (2013.01); *F15B 21/041* (2013.01)

(58) Field of Classification Search
CPC ..... E02C 19/109; E02C 19/47; E02C 19/475; F15B 13/07; F15B 21/041; E01C 19/109; E01C 19/47; E01C 19/475
See application file for complete search history.

(56) References Cited

U.S. PATENT DOCUMENTS 3,945,208 A 3/1976 O'Connor
5,772,868 A 6/1998 Reinhardt
(Continued)

FOREIGN PATENT DOCUMENTS

DE 35 28 067 A1 2/1987
DE 195 11 482 A1 10/1996
(Continued)

OTHER PUBLICATIONS

International Search Report of PCT/EP2012/065931, mailed May 13, 2013.
(Continued)

*Primary Examiner* — F. Daniel Lopez
(74) *Attorney, Agent, or Firm* — Collard & Roe, P.C.

(57) ABSTRACT

The invention relates to a hydraulic system, preferably for piloting and actuating a two-cylinder thick matter pump. The hydraulic system comprises a tank (68) for receiving hydraulic oil, a primary circuit having at least one hydraulic consumer (AH, MH) which has at least one primary pump (36, 38, 61, 70), which is loaded with hydraulic oil via a first suction line (42), and is connected on the outlet side to at least one first return line, and which has a suction/return filter (40) which communicates with the first suction line (42) on the outlet side and is loaded on the inlet side with return oil from the at least one return line. A special feature of the invention consists in that the first suction line (42) communicates with the tank (68) via a separate replenishing suction line (86) and a suction filter (66), wherein a replenishing suction valve (88) which is preloaded in the direction
(Continued)

Figure 1A:
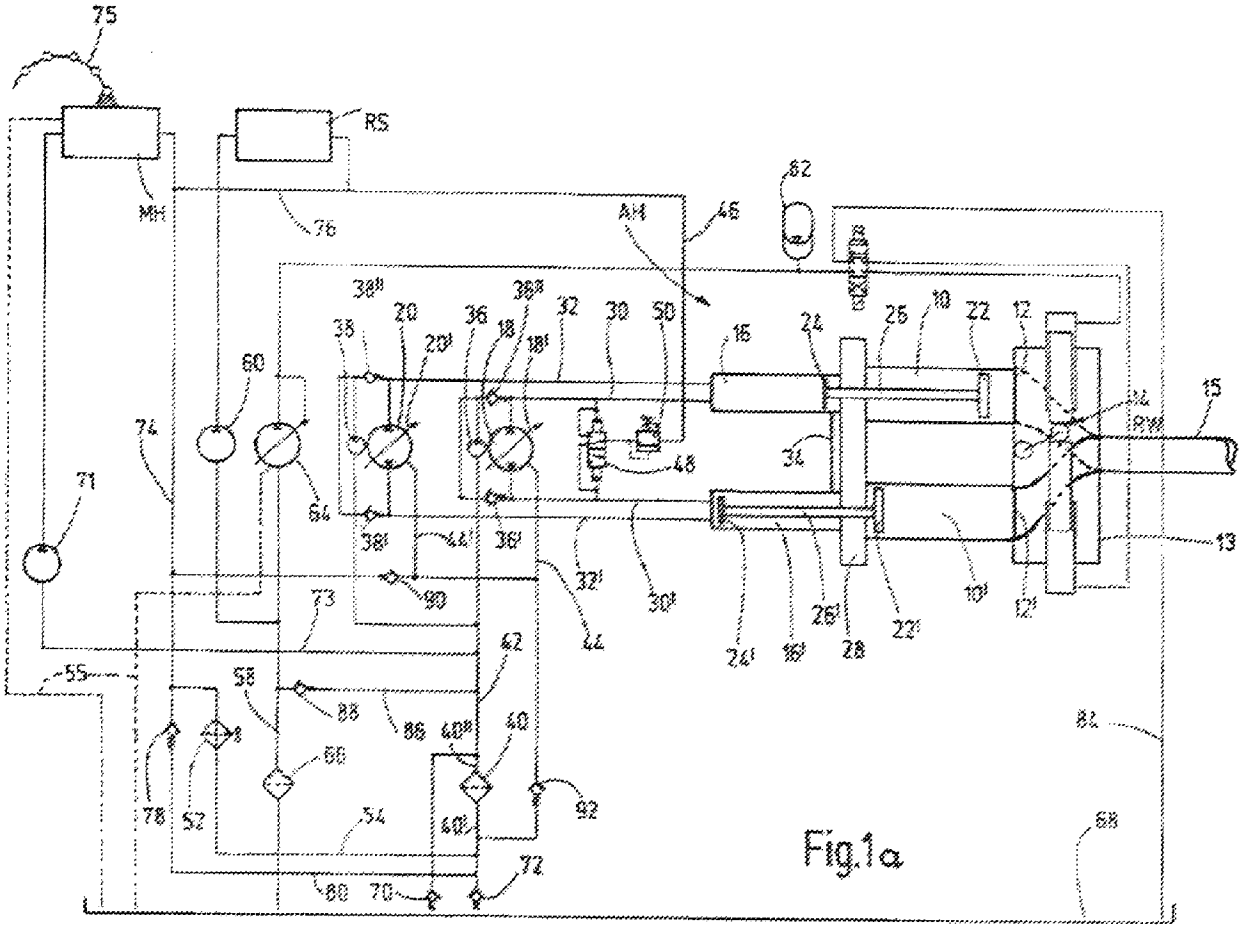

of the suction filter (66) is arranged in the replenishing suction line (86).

8 Claims, 4 Drawing Sheets

(51) Int. Cl.
*F15B 21/04* (2006.01)
*F15B 1/027* (2006.01)

(56) References Cited

U.S. PATENT DOCUMENTS

| | | | | |
|---|---|---|---|---|
| 6,171,075 | B1 | 1/2001 | Münzenmaier et al. | |
| 7,553,408 | B2 * | 6/2009 | Nystrom | F15B 21/041 123/196 A |
| 8,480,774 | B2 | 7/2013 | Wilkendorf et al. | |
| 2008/0016862 | A1 * | 1/2008 | Von Baumen | F15B 11/055 60/464 |

FOREIGN PATENT DOCUMENTS

| | | | |
|---|---|---|---|
| DE | 195 42 258 | A1 | 5/1997 |
| DE | 10 2006 051 821 | A1 | 5/2008 |
| DE | 10 2009 008 517 | A1 | 8/2010 |
| EP | 2 363 189 | A1 | 9/2011 |

OTHER PUBLICATIONS

German Search Report in DE 10 2011 083 874.0 dated Jun. 14, 2012.

Michael Gensberger, "Hydraulik—Grundlagen und Komponenten", Jun. 30, 2010, Hydac Service GmbH, Training Center, pp. 274-275.

"Rücklauf-Saugfilter RKM. Die neue Generation", Apr. 1, 2010, pp. 1-10, XP055060984 retrieved from the internet on Apr. 24, 2013; URL:http://www.hydac.com/de-de/produkte/filtration-und-pflege/hydraulik-und-schmieroelfilter/komplettfilter/ruecklauf-saugfilter.html.

* cited by examiner

HYDRAULIC SYSTEM WITH SUCTION/RETURN FILTER

CROSS REFERENCE TO RELATED APPLICATIONS

This application is the National Stage of PCT/EP2012/065931 filed on Aug. 15, 2012, which claims priority under 35 U.S.C. §119 of German Application No. 10 2011 083 874.0 filed on Sep. 30, 2011, the disclosure of which is incorporated by reference. The international application under PCT article 21(2) was not published in English.

The invention relates to a hydraulic system, preferably for the drive and actuation of a mobile thick-matter pump, having a tank, which is at atmospheric pressure, for accommodating hydraulic oil, having a primary circuit that drives at least one hydraulic consumer, which primary circuit has at least one motor-driven primary pump that is charged with hydraulic oil via a first suction line and is connected at the outlet side to at least one first return line, and which primary circuit has a suction/return filter which communicates at the outlet side with the first suction line and which, at the inlet side, is charged with returned oil from the at least one return line, and having a branch line which is branched off from the first suction line and which issues into the tank via a preload valve.

The invention differs from conventional thick-matter pumps in that the suction line to the primary pump and the return lines from the primary circuit do not issue into the tank, and instead the suction line communicates with the outlet side of the suction/return filter, whereas the return lines are connected to the inlet side of the suction/return filter. This so-called suction/return filter system requires an excess oil quantity in order, for example, to compensate for leakage oil quantities that are conducted directly to the tank, or in order to compensate for oil quantities briefly absent from the return line owing to the compressibility of the hydraulic oil on the pressure side. Accordingly, according to the invention, a secondary circuit is proposed, which secondary circuit has at least one motor-driven secondary pump which is charged with hydraulic oil via a second suction line and is connected at the outlet side to at least one second return line, wherein the second suction line preferably communicates with the tank via a suction filter, and the second return line either issues into the tank or is connected to the inlet side of the suction/return filter. The remaining excess oil quantity in the suction/return filter system is conducted to the tank via the preload valve.

With the suction/return filter system, it is achieved that, by means of the excess oil quantity in conjunction with the preload valve, optimum suction conditions are achieved for the primary pumps connected to the first suction line in the primary circuit, that the cold-start behavior is improved owing to the preload, and that the oil quantity conducted through the tank is significantly reduced, such that a significantly smaller tank volume can be used, thus permitting a weight reduction and cost reduction in the event of an oil change.

It has however been found that, in the case of thick-matter pumps, the operation of consumers with differential cylinders, for example during the deployment of the vehicle supports or during the deployment of the boom, can lead to a considerable supply deficit in the suction/return filter system.

To eliminate this disadvantage, it is also proposed according to the invention that the first suction line communicates with the tank via a separate replenishment suction line of large dimensions and a further suction filter, and that, in the replenishment suction line, there is arranged a replenishment suction valve which is preloaded in the direction of the further suction filter.

Here, the suction filter in the second suction line may be used as further suction filter. A preferred refinement of the invention provides that an oil cooler is arranged in at least one of the return lines. This is of importance in particular if heating of the hydraulic oil occurs during operation. Furthermore, in a preferred refinement of the invention, it is proposed that a check valve is arranged in at least one of the return lines that are connected to the inlet side of the suction/return filter.

A preferred refinement of the invention provides that at least one of the primary pumps in the primary circuit is in the form of a charging and feed pump of a two-cylinder thick-matter pump that is driven by means of a reversing pump. What is involved here is a closed hydraulic circuit that is led via the reversing pump, wherein in the terminology of the present invention said hydraulic circuit forms, together with the reversing pump, the consumer. In this case, one of the return lines is for example in the form of a leakage oil line of the reversing pump. If, to increase the cooling power, the leakage oil of the reversing pump must be conducted via an oil cooler, it may be necessary for a check valve to be provided in the associated return line in order to protect the reversing pump against pressure peaks from the other return lines. Furthermore, it is then necessary for a check valve to be provided which is connected directly to the outlet side of the suction/return filter or leads directly into the tank.

A further advantageous refinement of the invention provides that one of the return lines is in the form of a scavenging oil line that is connected to the outlet side of a scavenging shuttle valve of the reversing pump, said scavenging oil line preferably being led back to the suction/return filter via the oil cooler.

It is basically also possible for one of the hydraulic primary pumps to be connected to the drive hydraulics of a placing boom as consumer, the return line of which is connected to the inlet side of the suction/return filter.

It is advantageous for one of the primary pumps or of the secondary pumps to be connected to a hydraulic stirring mechanism drive, the return line of which is connected to the inlet side of the suction/return filter. Furthermore, one of the secondary pumps in the secondary circuit may be connected to the drive hydraulics of a pipe switch or of a slide valve of the thick-matter pump, the return line of which issues into the tank. Furthermore, it is also possible for there to be provided in the secondary circuit a separate hydraulic secondary pump which is connected with its pressure side to the inlet side of the suction/return filter and which delivers at least a part of the required excess oil.

To ensure that the suction/return filter is protected against excessively high pressure differences, it is advantageous for a check or bypass valve to be arranged between the inlet side of the suction/return filter and the tank.

The invention will be explained in more detail below on the basis of the exemplary embodiments schematically illustrated in the drawing, in which FIGS. 1*a*, 1*b* and 2*a*, 2*b* show hydraulic circuit layouts of hydraulic systems for the drive and actuation of a two-cylinder thick-matter pump with suction/return filter.

The hydraulic circuits shown in FIGS. 1*a*, 1*b* and 2*a*, 2*b* are designed for a thick-matter pump which has two delivery cylinders 10, 10', the end-side openings 12, 12' of which issue into a material-supply vessel 13 and, by means of a pipe switch 14 or a slide valve 17, can be connected to a delivery line 15 alternately during a pressure stroke. The delivery cylinders 10, 10' are driven in opposite stroke movements by means of hydraulic drive cylinders 16, 16' and the hydraulic reversing pumps 18, 20 which, in the exemplary embodiment shown, are in the form of swash-plate-type axial piston pumps. For this purpose, the delivery pistons 22, 22' are connected to the drive pistons 24, 24' of the drive cylinders 16, 16' by means of in each case one common piston rod 26, 26'. Between the delivery cylinders 10, 10' and the drive cylinders 16, 16' there is situated a water box 28 through which the piston rods 26, 26' extend.

In the exemplary embodiments shown, the drive cylinders 16, 16' are, at the base side, charged with hydraulic oil by means of the reversing pumps 18, 20 via hydraulic lines 30, 30', 32, 32' of a closed main circuit, and are hydraulically connected to one another at their rod-side ends via an oil oscillation line 34. The movement direction of the drive pistons 24, 24' and thus of the delivery pistons 22, 22' is reversed by virtue of the swashplates 18', 20' of the reversing pumps 18, 20, in response to a reversing signal, being pivoted through their zero position and thus changing the delivery direction of the hydraulic oil in the hydraulic lines 30, 30', 32, 32' of the main circuit.

In the terminology of the present invention, the drive cylinders 16, 16' together with the reversing pumps 18, 20 form a consumer AH (drive hydraulics) of the primary circuit of the two-cylinder thick-matter pump. The primary pumps 36, 38, which are in the form of feed and charging pumps, charge the consumer circuit AH via the check valves 36', 36", 38', 38". The primary pumps 36, 38 are arranged in a suction/return system which has a first suction line 42 connected to the outlet side 40" of a suction/return filter 40 and whose leakage oil lines extending from the reversing pumps 18, 20 are connected, as return lines 44, 44', to the inlet side 40' of the suction/return filter 40. A further return line 46 is branched off from the drive hydraulics AH via a scavenging shuttle valve 48 and a low-pressure limiting valve 50, and is led back to the inlet side 40' of the suction/return filter 40 via the oil cooler 52 and the line 54.

In the primary circuit with the suction/return filter system, an excess oil quantity is required in order, for example, to compensate for leakage oil quantities that flow via the lines 55 to the tank 68, or in order to compensate for oil quantities briefly absent from the return line owing to the compressibility of the hydraulic oil on the pressure side. The excess oil quantity is generated at least partially by means of a motor-driven hydraulic secondary pump 60, 62 which is arranged in the secondary circuit and which is charged with hydraulic oil via at least one second suction line 58. The second suction line 58 communicates with the tank 68 either directly or via a suction filter 66. At the outlet side, the secondary circuit is connected to at least one return line which either issues into the tank 68 or is connected to the inlet side 40' of the suction/return filter 40.

The remaining excess oil quantity in the suction/return filter circuit is conducted via a preload valve 70 to the tank 68. The suction/return filter system is also provided with a check valve on the inlet side 40' of the suction/return filter 40, which check valve, as a bypass valve 72, protects the filter element of the suction/return filter 40 against excessively high pressure differences.

The advantages of the suction/return filter system consist in particular in that the excess oil quantity in conjunction with the preload valve 70 yields optimum suction conditions for the primary pumps in the primary circuit. Furthermore, the cold-start behavior of the primary pumps is improved, and the oil quantity circulating through the tank 68 is reduced. The latter also has the effect that the tank volume can for example be reduced to less than half of the otherwise conventional size, and thus the tank and oil weight and the oil quantity to be exchanged during an oil change are reduced.

In the exemplary embodiment shown in FIGS. 1*a*, 1*b* and 2*a*, 2*b*, the circuit NM for the actuation and control of the placing boom 75 is also a consumer of the primary circuit. The supply for the boom control is realized by means of the further primary pump 71, the suction side of which is connected via the line 73 to the first suction line 42 at the outlet 40" of the suction/return filter 40, and the return line 74 of which is led back to the inlet side of the suction/return filter via the oil cooler 52 and the line 54. The support control, which serves for the support of the mobile concrete pump on the ground by way of its hydraulically actuable support legs, may also be integrated in the consumer part MH for the boom control. In the case of concrete pumps of this type, the operation of consumers with differential cylinders, such as are used for example for the deployment of the support legs and for the deployment of the boom 75, can lead to a considerable supply deficit in the suction/return filter system. In the exemplary embodiment shown, this is partially compensated by means of a large excess oil quantity which, in the secondary circuit, is recirculated to the suction/return filter 40 by means of a large secondary pump 60, 62 which is connected to the tank 68.

Figure 1B:
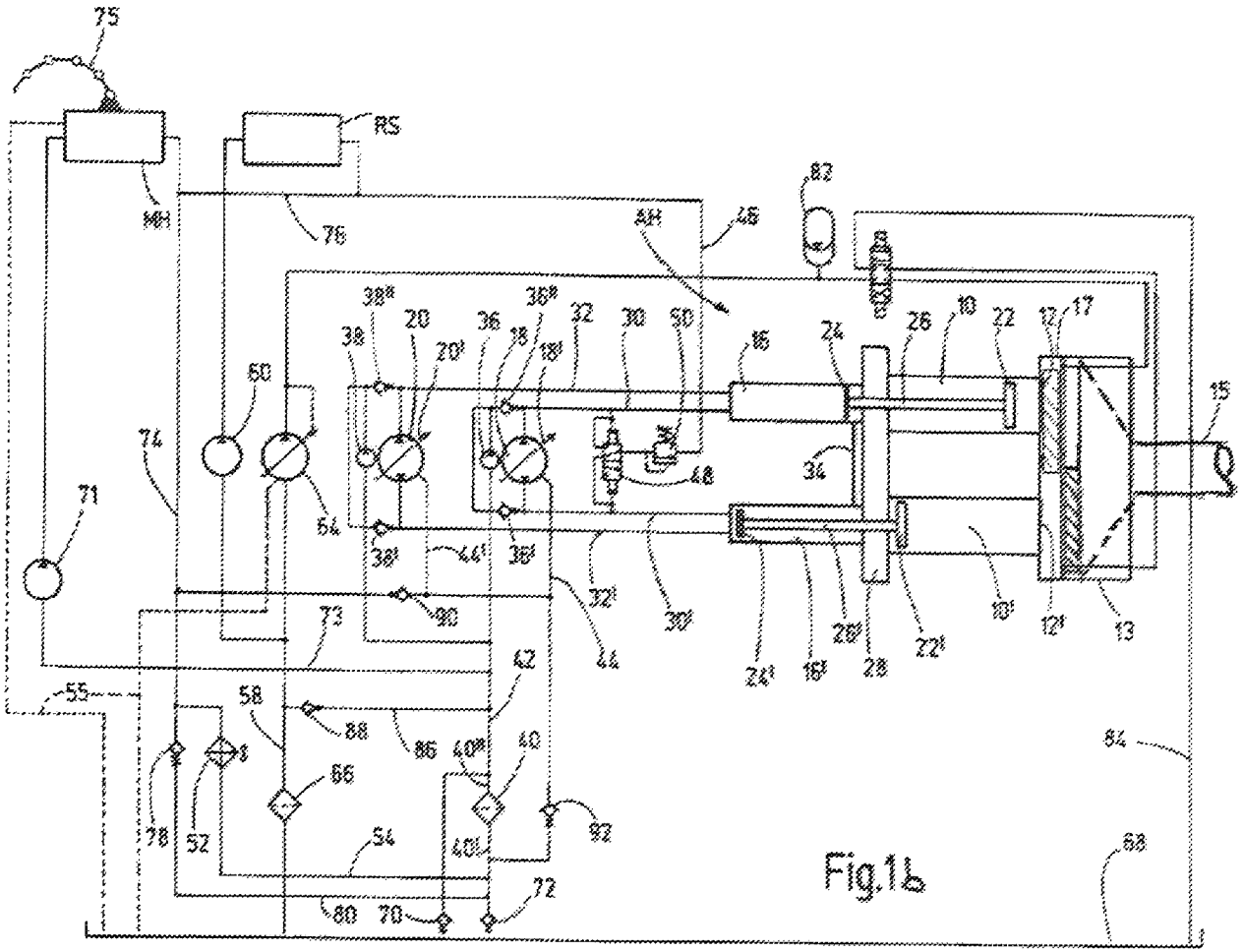
Figure 2A:
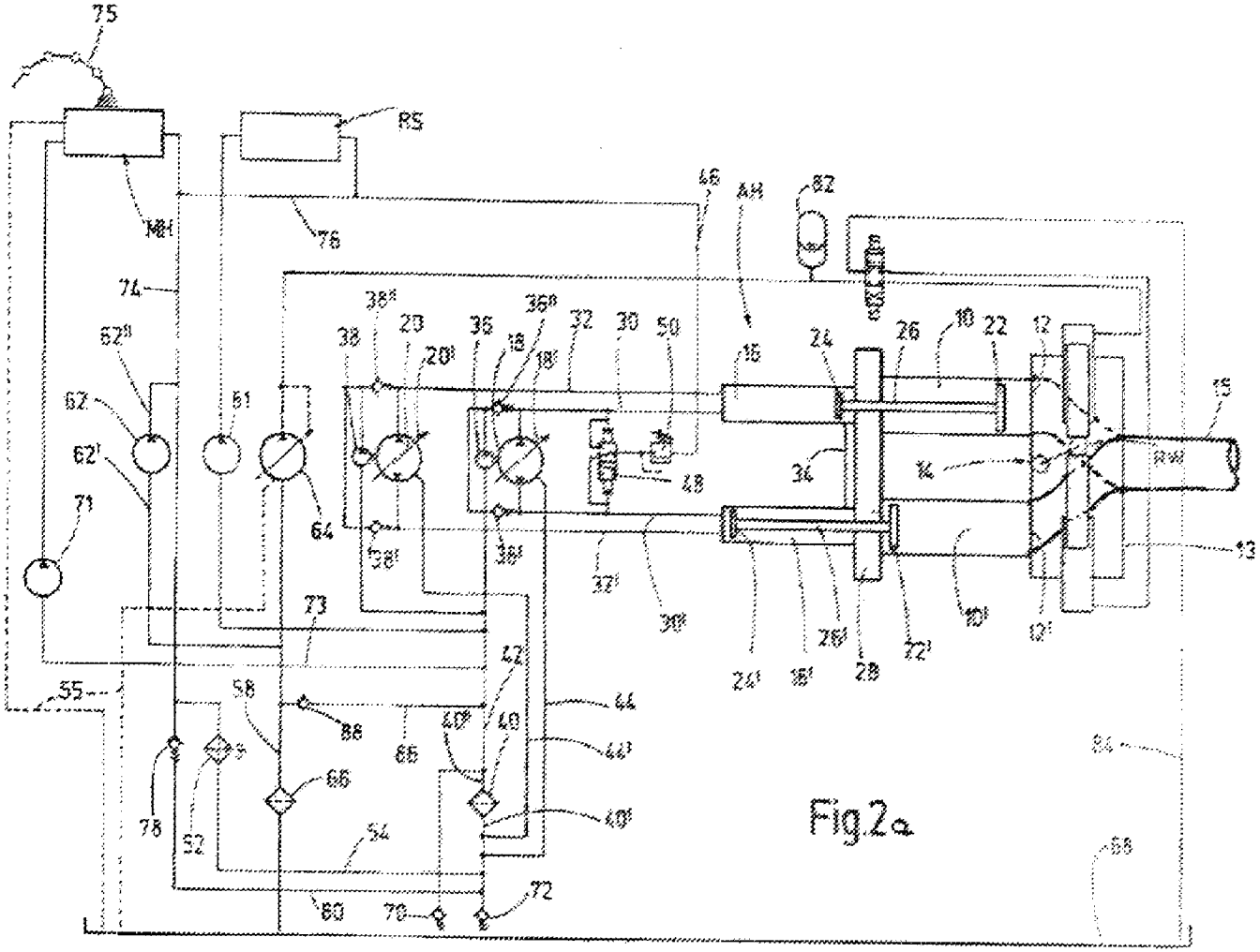
Figure 2B:
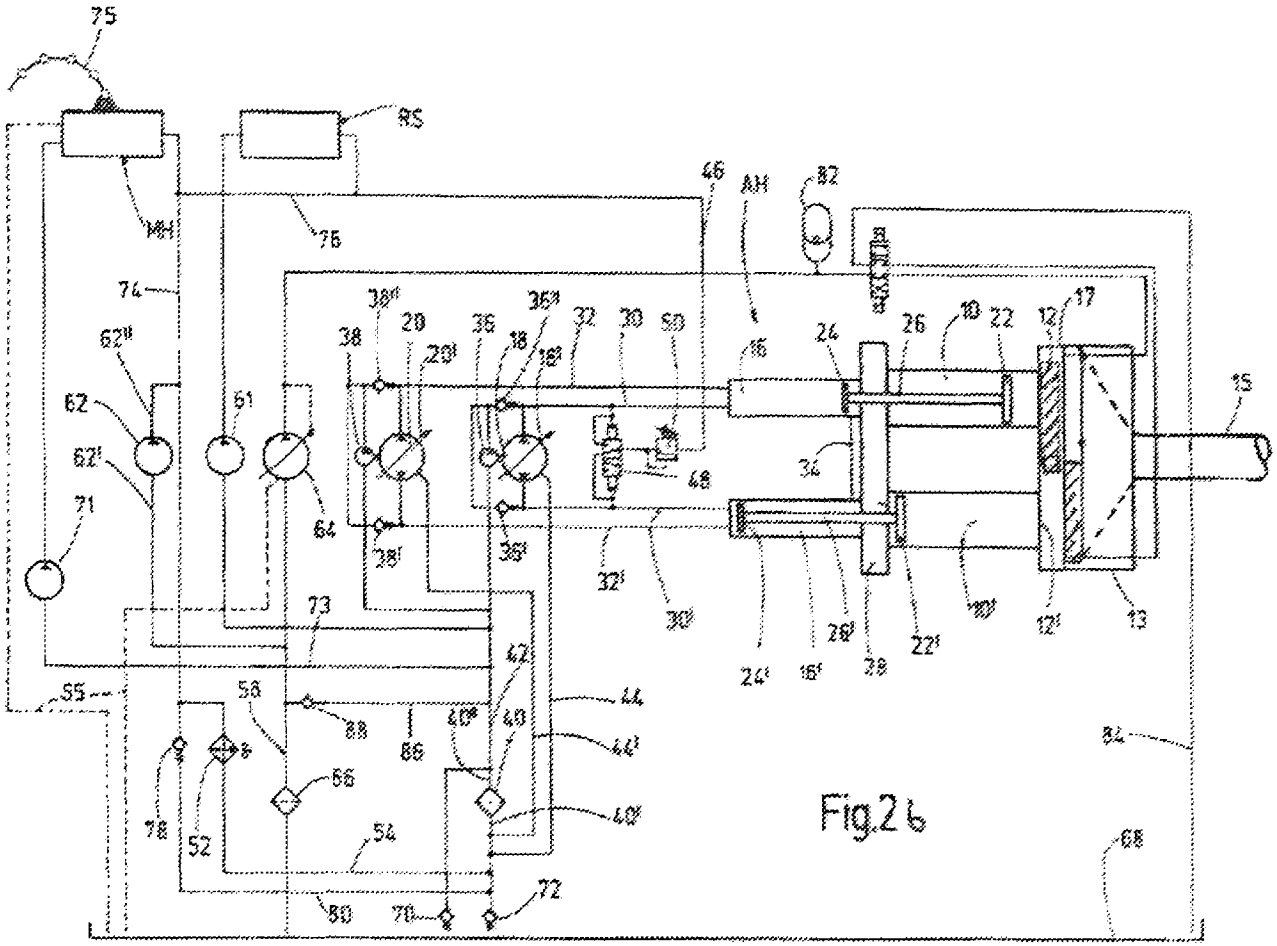

In the exemplary embodiment shown in FIGS. 1*a* and 1*b*, for this purpose, use is made in particular of the secondary pump 60 which serves for the drive of a stirring mechanism RS, as a consumer, arranged in the material-supply vessel, the return line 76 of which secondary pump is led back to the inlet 40' of the suction/return filter 40 via the oil cooler 52 and the outlet line 54. The exemplary embodiment of FIGS. 2*a* and 2*b* differs from FIGS. 1*a* and 1*b* in this regard in that the stirring mechanism controller RS is supplied with hydraulic oil by means of a primary pump 61 via the suction/return filter 40 and the first suction line 42, and is thus a constituent part of the primary circuit. By contrast, in the exemplary embodiment of FIGS. 2*a* and 2*b*, a secondary pump 62 is provided in the secondary circuit, which secondary pump is intended exclusively for the provision of the excess oil quantity, the suction side 62' of which secondary pump communicates with the tank 68 via the second suction line 58 and the suction filter 66 and the pressure side 62" of which secondary pump is led back to the inlet side 40' of the suction/return filter 40 either via the oil cooler 52 and the line 54 or via the check valve 78 and the Line 80.

The hydraulic pump 64 for the hydraulic accumulator 82 of the pipe switch circuit RW may also be connected to the suction filter 66. The return line 84 of the pipe switch circuit RW must however be led to the tank 68 separately, because pressure peaks inadmissible for the suction/return filter 40 arise here.

A further special feature of the invention consists in that at least a part of the excess oil quantity is provided via a separate, adequately dimensioned replenishment suction line 86. In the exemplary embodiment shown, said replenishment suction line 86 is connected to the suction filter 66, from which the primary pumps 36, 38, 61, 70 of the primary circuit draw hydraulic oil via a replenishment suction valve 88 and the first suction line 42. The replenishment suction line 86 must at least be dimensioned such that, at a maximum replenishment suction rate, the flow speed in the replenishment suction line does not exceed 0.8 m/s, and the negative pressure does not fall below the admissible minimum value, for example 0.8 bar, of the primary pump imparting the suction action. Furthermore, the replenishment suction line 86 and the replenishment suction valve 88 must be of adequately large dimensions, because an operating state may arise in which only the primary pump 71 of the boom hydraulics MH is in operation and the drive for the other hydraulic pumps is deactivated. Here, the secondary pump 60 or 62 for the excess oil quantity is then also out of operation. Depending on whether the differential cylinders in the boom hydraulics MH or in the support hydraulics are being deployed or retracted, either an excess of oil arises at the suction/return filter 40, which excess is conducted via the preload valve 70 to the tank 68, or an oil deficit arises, which must then be compensated for from the tank 68 via the replenishment suction line 86 and the replenishment suction valve 88 and the suction filter 66.

The exemplary embodiment of FIGS. 1*a* and 1*b* additionally includes the special feature that the leakage oil from the reversing pumps 18, 20 is conducted at least partially via the oil cooler 52, in order hereby to realize an increase in cooling power. In this case, it has proven to be expedient for a check valve 90 to be provided in the leakage oil line 44, 44' in order to protect the reversing pumps 18, 20 of the consumer AH against pressure peaks from the other return lines. Furthermore, it is then necessary for a check valve 92 to be provided which, at the outlet side, is connected directly to the inlet 40' of the suction/return filter 40 or leads directly into the tank 68.

In summary, the following can be stated: the invention relates to a hydraulic system, preferably for the drive and actuation of a two-cylinder thick-matter pump. The hydraulic system comprises a tank 68 for accommodating hydraulic oil, a primary circuit with at least one hydraulic consumer AH, MH, which primary circuit has at least one primary pump 36, 38, 61, 70 that is charged with hydraulic oil via a first suction line 42, which primary circuit is connected at the outlet side to at least one first return line, and which primary circuit has a suction/return filter 40 which communicates at the outlet side with the first suction line 42 and which, at the inlet side, is charged with returned oil from the at least one return line. A special feature of the invention consists in that the first suction line 42 communicates with the tank 68 via a separate replenishment suction line 86 and a suction filter 66, wherein, in the replenishment suction line 86, there is arranged a replenishment suction valve 88 which is preloaded in the direction of the suction filter 66.

LIST OF REFERENCE SIGNS

10, 10' Delivery cylinders
12, 12' Openings
13 Material supply vessel
14 Pipe switch
15 Delivery line
16, 16' Drive cylinders
17 Slide valve
18, 20 Reversing pumps
18', 20' Swashplates
22, 22' Delivery pistons
24, 24' Drive pistons
26, 26' Piston rods
28 Water box
30, 30', 32, 32' Hydraulic lines (AH)
34 Oil oscillation line (AH)
36, 38 Primary pumps
40 Suction/return filter
40' Inlet side
40" Outlet side
42 First suction line
44, 44' Leakage oil lines (return line)
46 Scavenging line (return line)
48 Scavenging shuttle valve
50 Low-pressure limiting valve
52 Oil cooler
54 Return line
55 Leakage oil lines
58 Second suction line
60 Secondary pump (RS)
61 Primary pump (RS)
62 Separate secondary pump
64 Hydraulic pump
66 Suction filter
68 Tank
70 Preload valve
71 Primary pump (MH)
72 Bypass valve
73 Suction line (MH)
74 Return line (MH)
75 Placing boom
76 Stirring mechanism controller (RS)
78 Check valve
80 Return line (S, MH)
82 Hydraulic accumulator
84 Return line (RW)
86 Replenishment suction line
88 Replenishment suction valve
90 Check valve
92 Check valve
AH Drive hydraulics (consumer)
MH Boom hydraulics (consumer)
RS Stirring mechanism controller (consumer)
RN Pipe switch (consumer)

The invention claimed is:

1. An apparatus comprising:

(a) first and second delivery cylinders containing respectively first and second delivery pistons and first and second end-side openings;

(b) a delivery line alternately connected to the first and second delivery cylinders during a respective pressure stroke of the first and second delivery pistons;

(c) first and second hydraulic drive cylinders containing respectively first and second drive pistons connected to the first and second delivery pistons via first and second common piston rods, respectively;

(d) drive hydraulics comprising a reversing pump actuating and controlling the first and second drive pistons;

(e) a placing boom;

(f) boom hydraulics actuating and controlling the placing boom; and (g) motor-driven first and second primary pumps;

wherein the drive hydraulics and the boom hydraulics form a common primary circuit having a tank at atmospheric pressure for accommodating hydraulic oil;

wherein the primary circuit comprises the first primary pump, the first primary pump being charged with the hydraulic oil via a first suction line, wherein the primary circuit is connected at a first outlet side to at least one first return line, and has a suction/return filter communicating at the first outlet side with the first suction line and being charged at an inlet side with returned oil from the at least one first return line, wherein the first primary pump comprises a charging and feed pump of the drive hydraulics and the second primary pump is connected to the boom hydraulics;

wherein a branch line branches off from the first suction line and issues into the tank via a preload valve;

wherein the apparatus further comprises a secondary circuit comprising a motor-driven secondary pump charged with the hydraulic oil via a second suction line;

wherein the motor-driven secondary pump is connected at a second outlet side to at least one second return line; wherein the second suction line communicates with the tank directly or via a suction filter (66); and wherein the at least one second return line is connected to the inlet side of the suction/return filter;

wherein the first suction line communicates with the tank via a separate replenishment suction line and the suction filter, and wherein a replenishment suction valve preloaded toward the suction filter is arranged in the replenishment suction line.

2. The apparatus as claimed in claim 1, further comprising a third return line comprising a scavenging oil line connected to a third outlet side of a scavenging shuttle valve of the primary circuit.

3. The apparatus as claimed in claim 1, wherein an oil cooler is arranged in the at least one first return line leading to the suction/return filter.

4. The apparatus as claimed in claim 1, wherein a check valve is arranged in the at least one first return line connected to the inlet side of the suction/return filter.

5. The apparatus as claimed in claim 1, wherein the motor-driven secondary pump is connected to a hydraulic stirring mechanism drive having a return line connected to the inlet side of the suction/return filter.

6. The apparatus as claimed in claim 1, wherein the motor-driven secondary pump is connected to the drive hydraulics, wherein the drive hydraulics have a return line issuing into the tank.

7. The apparatus as claimed in claim 1, wherein the motor-driven secondary pump has a pressure side connected to an inlet of the suction/return filter.

8. The apparatus as claimed in claim 1, wherein a check or bypass valve is arranged between the inlet side of the suction/return filter and the tank.

* * * * *